US006602043B2

(12) United States Patent
Honda

(10) Patent No.: US 6,602,043 B2
(45) Date of Patent: Aug. 5, 2003

(54) CARD ISSUER, CARD PROCESSOR AND CARD STACKER METHOD

(75) Inventor: Yoshito Honda, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/199,698

(22) Filed: Jul. 19, 2002

(65) Prior Publication Data

US 2002/0180140 A1 Dec. 5, 2002

Related U.S. Application Data

(62) Division of application No. 09/855,909, filed on May 15, 2001.

(51) Int. Cl.[7] ..... B65G 59/06

(52) U.S. Cl. ..... 414/801; 271/160; 271/166

(58) Field of Search ..... 414/797.6, 797.7, 414/797.8, 797.9, 801; 271/160, 161, 166, 35

(56) References Cited

U.S. PATENT DOCUMENTS

| | | | | | |
|---|---|---|---|---|---|
| 1,394,613 | A | * | 10/1921 | Drury | 271/119 |
| 2,689,731 | A | * | 9/1954 | Peters | 271/166 |
| 3,949,980 | A | * | 4/1976 | Hartka | 271/134 |
| 4,010,944 | A | * | 3/1977 | Young | 271/134 |
| 4,021,032 | A | * | 5/1977 | Gross et al. | 271/166 |
| 4,630,812 | A | * | 12/1986 | Yano et al. | 271/132 |
| 5,829,631 | A | * | 11/1998 | Kasper | 221/198 |

* cited by examiner

*Primary Examiner*—Janice L. Krizek
(74) *Attorney, Agent, or Firm*—John E. Campbell; Floyd A. Gonzalez

(57) ABSTRACT

A credit card stacker holding up to a predetermined number of cards in a lower section. Cards are supplied by a separator mechanism from the upper section of the card stacker, as they are depleted from the lower section by the issuing mechanism. The separator mechanism supports one edge of a card in the upper section only while the other edge of the card is supported by a predetermined number of cards in the lower section. When the number of cards in the lower section drops below the predetermined number, the separator mechanism allows cards to drop to the lower section.

7 Claims, 8 Drawing Sheets

CARD ISSUER, CARD PROCESSOR AND CARD STACKER METHOD

CROSS REFERENCE TO RELATED APPLICATION

This application is a divisional of U.S. patent application Ser. No. 09/855,909, filed May 15, 2001, entitled "Card Issuer, Card Processor and Card Stacker Method and Apparatus", the entirety of which is hereby incorporated herein by reference.

TECHNICAL FIELD OF THE INVENTION

The present invention relates to a card issuer, more particularly to a card issuer which is capable of selecting and supplying magnetic cards (optionally having embosses or magnetic strips) one by one from a stack of a plurality of cards.

BACKGROUND OF THE INVENTION

Apparatus for selecting and supplying one card from a large number of cards in a stack is known. For example, in the gazettes of Japanese Patent Laid-Open Nos. Sho 56-45196 and Hei 7-35210, a card issuer 100 shown in FIG. 8 is disclosed. The card issuer 100 is slidably equipped with a press plate 130 in a hopper 120 having a length L in width, which is slightly shorter than a length of a card 110. At a card outlet 180 of the hopper 120, a feeding roller 140 is disposed in a state where a part of the circumferential surface of the feeding roller 140 projects inside the hopper. A separator 150 is disposed in the hopper 120, and this separator 150 is disposed in such a manner that a tip thereof is separated from an outer circumference of the feeding roller 140, spaced with an interval equivalent to a thickness of one card. The card 110 is inserted in the hopper 120 to a wall 120*a* along a card feeding direction of the hopper 120 in an orientation where a tip thereof contacts the feeding roller 140. The card 110 is always pressed toward the feeding roller 140 by a press plate 130. A pressure imparted to the press plate 130 is obtained by disposing springs 160 between a wall portion of the hopper 120 and the press plate 130.

When the feeding roller 140 rotates, the card 110 at the uppermost portion is sent out by a frictional force of the feeding roller 140. In this case, as shown in FIG. 9, as the card 110 is sent out, it begins to rotate with its contact point with the feeding roller 140 as a rotational center. Finally, the card 110 is discharged through a feeding path 170.

The above-described card issuer 100 adopts a system in which the card 110 at the uppermost portion is selected from a large number of the cards 110 stacked in a vertical direction. Further, there is known another card issuer in which a card at the lower most portion is selected one by one. In the card issuer of this system, a card located at the lowermost portion is made to contact a feeding roller (or a feeding belt) similar to that of the card issuer 100. Thus, one card is selected by a frictional force or extruded by use of an extrusion member.

Also in the gazette of Japanese Patent Laid-Open No. Hei 7-53068, a card issuer 200 shown in FIG. 10 is disclosed. In the card issuer 200, a feeding roller 221 of a cassette 220 is rotated by a motor 222 in a direction where a card 210 is drawn to a floor surface 224 (arrow direction in the drawing). Then, among the stacked cards 210 pressed with a pressure P by a press member 225, the forefront card 210 contacting the feeding roller 221 is extruded by the frictional force of the feeding roller 221 with an angle in a direction of a floor surface opposite from the press member 225. The card 210 passes under the feeding roller 221 bending in J-character shape as shown in FIG. 11, advances forward along a floor surface 224 and is discharged from a feeding port 226.

Both of the above-described card issuers 100 and 200 feed cards by frictional forces of the feeding rollers (140 and 221). Besides these, a card issuer adopting a system called a suction system is put into practical use. This card issuer suctions a card at the uppermost portion of stacked cards to take out the card.

There are a variety of cards handled by the card issuers. For example, there are a prepaid card, a cash card, a credit card and the like. The prepaid card does not have embosses on a surface thereof. Accordingly, the prepaid card can be easily separated and issued by the above-described conventional card issuers. However, in the case of the cash card and the credit card, each of which has embosses formed on a surface thereof, it is not easy to select one card from a plurality of stacked cards. Such embosses are typically made so as to mark a serial number of the card. Accordingly, in serial numbers of cards adjacent to each other in a stacked state, only the respective last numbers are different from each other, and the embosses forming the other characters overlap each other. For this reason, such overlapped embosses interlock and present resistance, and it is not easy to select one card from stacked embossed cards.

In the card issuer 100 shown in FIGS. 8 and 9, which is disclosed in the gazettes of Japanese Patent Laid-Open Nos. Sho 56-45196 and Hei 7-35210, it is assumed that a plurality of the cards 110 rotate keeping an overlapped state with a contact point thereof with the feeding roller 140 as a center. In this case, it is necessary to apply a considerable feeding force at the feeding roller 140 in order to release an overlap of the plurality of cards 110. However, this force also increases card to card friction due to the overlap of the embosses. Moreover, even if the overlap can be released, since the cards 110 are rubbed with each other by a strong frictional force, the surfaces of the cards 110 may be scratched. Furthermore, in the case where the overlap cannot be released, a plurality of overlapped cards 110 cannot pass through the narrow card outlet 180, leading to a malfunction of the card issuer 100.

In the above described system in which a card at the lowermost portion among stacked cards is selected by a feeding roller and the like, there exists a problem similar to the above. A card weight is one of the factors causing card to card friction due to the overlap of the card embosses. Since a load applied to the cards in the lower layer becomes larger when the number of the stacked cards is increased, the overlap friction becomes significant due to the increased load. When the number of the stacked cards is reduced, the overlap friction of the embosses becomes light, thus the problem that the card issue is disabled due to the overlap of the embosses is avoided. However, in this case, there occurs another problem, that is, troublesome maintenance that the frequency of replacing cards for the card issuer must be increased.

Moreover, in the card issuer 200 shown in FIGS. 10 and 11, which is disclosed in the gazette of Japanese Patent Laid-Open No. Hei 7-53068, it is a precondition that the card 210 is bent in a J-character shape. Accordingly, the card issuer 200 is not suitable as a card issuer for cards having high rigidity, such as a cash card and a credit card. Even if the card issuer 200 is applied to the cash card or the credit card, a feeding force of the feeding roller 221 must be considerably increased. This added force also functions to increase the overlap friction of the embosses similarly to the previous example. Even if the overlap can be released, since the cards 210 are rubbed with each other by a strong frictional force, the surfaces of the cards 210 can be scratched.

The card issuer of the suction system has a basic problem that a suction system thereof is large. The overlap friction of the card embosses may be caused by the card weight as described above. Specifically, since the load applied to the cards in the lower layer becomes large when the number of the stacked cards is increased, the overlap friction becomes significant due to the increased load. Since the card issuer of the suction system suctions the card at the uppermost portion of the stacked cards, an overlap of a card at the upper layer in a state of just being stacked is light. Since the card issuer of the suction system makes a suction force function to the card at the uppermost portion, there is no problem due to the overlap of the embosses where the card located in the upper layer is suctioned. However, since the overlap friction of the embosses is significant in the cards located in the lower layer, there is a possibility to suction a plurality of cards as the selecting of the cards proceeds. Moreover, the cards may be attached to each other by static electricity in some cases. In order to prevent the overlap of the plurality of the cards, a method can be conceived in which cards to be suctioned are vibrated to release an overlap thereof. However, since vibrating means must be provided to execute this method, such an apparatus becomes expensive.

As described above, the conventional, inexpensive card issuer cannot consistently select one card from a stack having a large number of the cards having embosses.

SUMMARY OF THE INVENTION

With the foregoing problems in mind, it is an object of the present invention to provide a card issuer, which is capable of accurately selecting one card from a holder where a plurality of cards having optional embosses formed thereon are stacked.

It is another object of the present invention to provide such a card issuer at a low cost.

In order to solve the foregoing problems, the present inventors experimented in selecting cards by varying the number of stacked cards having embosses. The card issuer used in the experiment adopted a system in which the card at the lowermost portion is selected from a plurality of cards stacked in a vertical direction.

As a result of the experiment, in the case of the current cash card or credit card, it was found that if the number of the stacked cards is less than about 20 to 30, it was possible to constantly select the card at the lowermost portion among the cards stacked in a vertical direction irrespective of the form of the embosses. In the case of the card issuer adopting the system in which the card at the lowermost portion among the cards stacked in a vertical direction is selected, the concerned card is selected by a frictional force between the card and a belt (or roller) generated by driving the belt made to contact the card to be selected. In this case, it is necessary to press the card to the belt by a predetermined pressure. When the cards are stacked, a load corresponding to the number of the stacked cards is applied to the card at the lowermost portion, which is to be selected. However, in the case of the card having embosses formed thereon, when this load is excessive, an overlap of the embosses becomes significant, resulting in difficulty of selecting a single card. The above-described number of 20 to 30 is the number in which the frictional force required for selecting the card is obtained and a condition where the card cannot be selected due to the overlap of the embosses does not occur.

According to the above-described result, when the number of the cards stacked in the card issuer is set to 20 to 30, a condition where the card cannot be selected due to the overlap of the embosses does not occur. However, when the number of the stacked cards is set to about 20 to 30, it is necessary to frequently replace cards for the card issuer. In other words, when the number of the cards stacked in the card issuer is about 20 to 30, it hinders an efficiency of a maintenance operation.

With the foregoing problems in mind, the present inventors studied means for preventing the state where the card cannot be selected due to the overlap of the embosses and for securing the efficiency of the maintenance operation. As a result, the present inventors found that it is effective to constantly limit a load applied to the card to be selected by stacking the cards. For example, in the case where the number of the entire stacked cards is set to a hundred, a load applied to the card at the lowermost portion is limited to the equivalent to that of the twenty five cards, and the load of the residual seventy five cards is not translated to the entire surface of cards at the lowermost portion, especially to the area thereof where the embosses are formed. In the case where the card at the lowermost portion is selected, the card is replaced with one from the residual seventy five cards.

According to the present invention, a card issuer, which sequentially issues stacked cards, comprises: a first stack portion in which the number of stacked cards to be issued is regulated at a predetermined value or less; a second stack portion, which stacks cards for replacing selected cards therewith to the first stack portion in the case where the card stacked in the first stack portion is selected; and selection means for selecting a card stacked in the first stack portion.

According to the card issuer of the present invention described above, the number of the cards stacked in the first stack portion is regulated at a predetermined value or less. Accordingly, a load applied to the card located at the lowermost portion by the other stacked cards can be controlled. In the case of the stacked cards having embosses formed thereon, the number of the cards stacked in the first stack portion may be set in order that a resistance due to the overlap of the embosses is not likely to prevent selection of the cards.

In consideration of the overlap of the embosses, it is difficult to stack a large number of cards only in the first stack portion. In the card issuer of the present invention, a second stack portion is provided. A desired number of the cards are stacked not only in the first portion, but in the second stack portion. Since the cards are sequentially selected and issued from the first stack portion, the cards are replaced from the second stack portion to the first stack portion.

When the selecting of the cards is repeated and the number of the cards stacked in the first stack portion falls below the predetermined value or less, the frictional force for selecting the card may not be provided only by the weight of the stacked cards in some cases. In such a case, a separate weight can be applied, capable of applying a predetermined load. The predetermined load is set (in combination with the weight of a maximum number of cards) to a range where the overlap friction of the embosses does not become excessive.

In the present invention, the card issuer can take a form in which the cards are stacked in a vertical direction (one above another), and the second stack portion is disposed above the first stack portion. Moreover, the card issuer for issuing the cards having the embosses formed thereon can be constructed in such a manner that a weight of cards stacked in the second stack portion is applied to an area of the cards in the first stack portion, away from the sensitive area of the card (where the embosses are formed). The reason for allowing this arrangement is as follows. Even if the load by the cards stacked in the second stack portion is applied to the cards stacked in the first stack portion, if the load is applied to the area where the embosses are not formed, the overlap friction of the embosses is not promoted. Furthermore, in the card issuer of the present invention, replacement of the cards from the second stack portion to the first stack portion may be performed by gravity.

According to the present invention, there is provided a card processor, which comprises: a card stacker for stacking cards in a vertical direction where the cards optionally have embossed areas; control means for controlling within a predetermined range, a load applied to the embossed area of the card located at the lowermost portion; and selection means for issuing the card located at the lowermost portion among the cards stacked in the card stacker.

According to the above-described card processor, the load applied to the embossed area of the card located at the lowermost portion can be controlled within a predetermined range. If the controlled load range is set within a range where the overlap of the embosses does not hinder the selecting of the card, the card can be selected smoothly. In the card processor of the present invention, the applied load can be controlled within a predetermined range even after the card located at the lowermost portion is selected by the issuing means.

The present invention provides a card stacker, which is effective for use of the above described card issuer and card processor of the present invention. Specifically, the card stacker of the present invention is a card stacker for stacking a plurality of cards stacked in a vertical direction, which comprises: a holding floor for holding the cards in a vertical direction; side walls for regulating a horizontal position of the cards, the side walls being erected from the holding floor; a card stack area for stacking the cards, the card stack area being formed by the holding floor and the side walls; and a projection, projecting into the card stack area, the projection being disposed at a position of a predetermined height of the side wall in the card stack direction.

In the card stacker of the present invention, the projection has a function for engaging one edge of the card. And, in the case where the card stacker is a card stacker for stacking cards having embosses formed thereon, it is desirable that the projection is formed on the side wall, which is close to the area where the embosses of the stacked cards are formed, on the side wall adjacent to the long side of the cards. With such a construction, weight of the card engaged on the projection and the cards stacked above the engaged card are prevented from being applied to the area of the embosses of the cards stacked below the projection.

Moreover, in the card stacker of the present invention, it is desirable that a portion of the projection, which engages the card, constitutes a slant surface.

These and other objects will be apparent to one skilled in the art from the following drawings and detailed description of the invention.

BRIEF DESCRIPTION OF THE DRAWINGS

The subject matter which is regarded as constituting the invention is particularly pointed out and distinctly claimed in the claims at the conclusion of the specification. The foregoing and other objects, features and advantages of the invention are apparent from the following detailed description taken in conjunction with the accompanying drawings in which:

FIG. 5(*a*) shows a condition before the card 10L is selected and fed; and FIG. 5(*b*) a condition after the card 10L is selected and fed;

DESCRIPTION OF THE PREFERRED EMBODIMENT

Description will be made for an embodiment of the present invention with reference to the accompanying drawings below.

Figure 1:
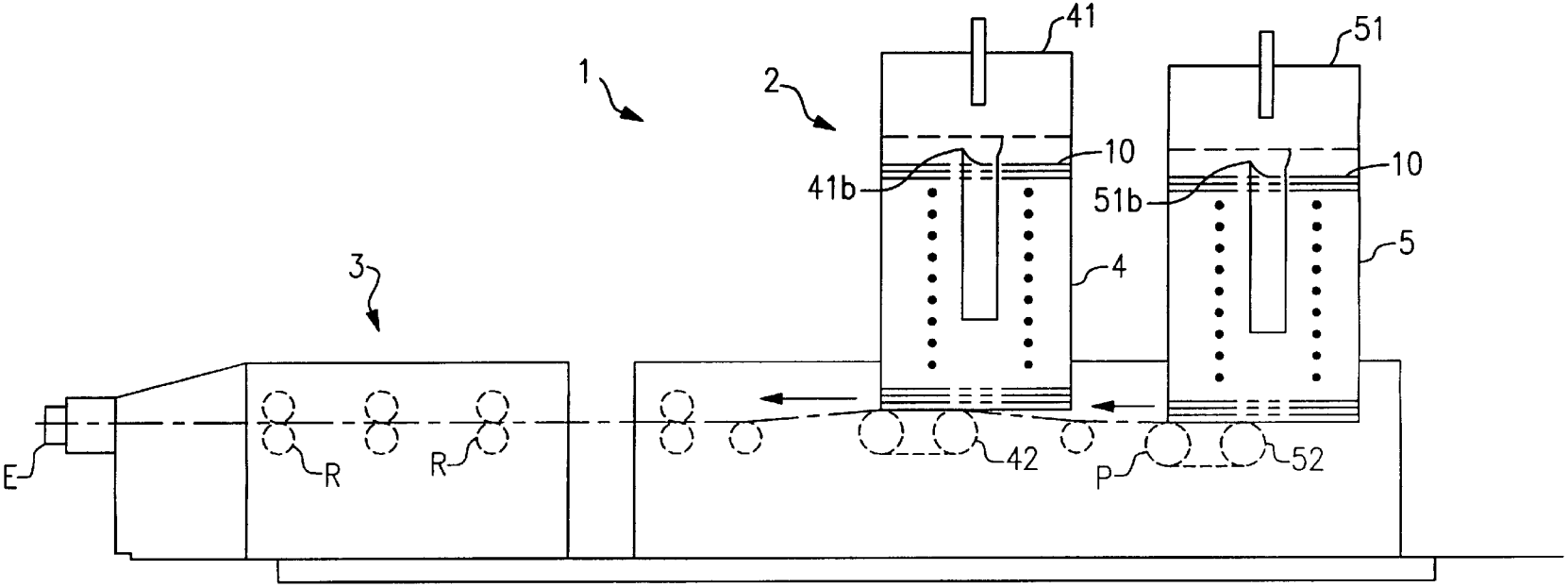
FIG. 1 is a conceptual view schematically showing a card issuer 1 according to an embodiment of the present invention.

FIG. 1 is a conceptual view schematically showing a card issuer 1 according to this embodiment.

Figure 7:
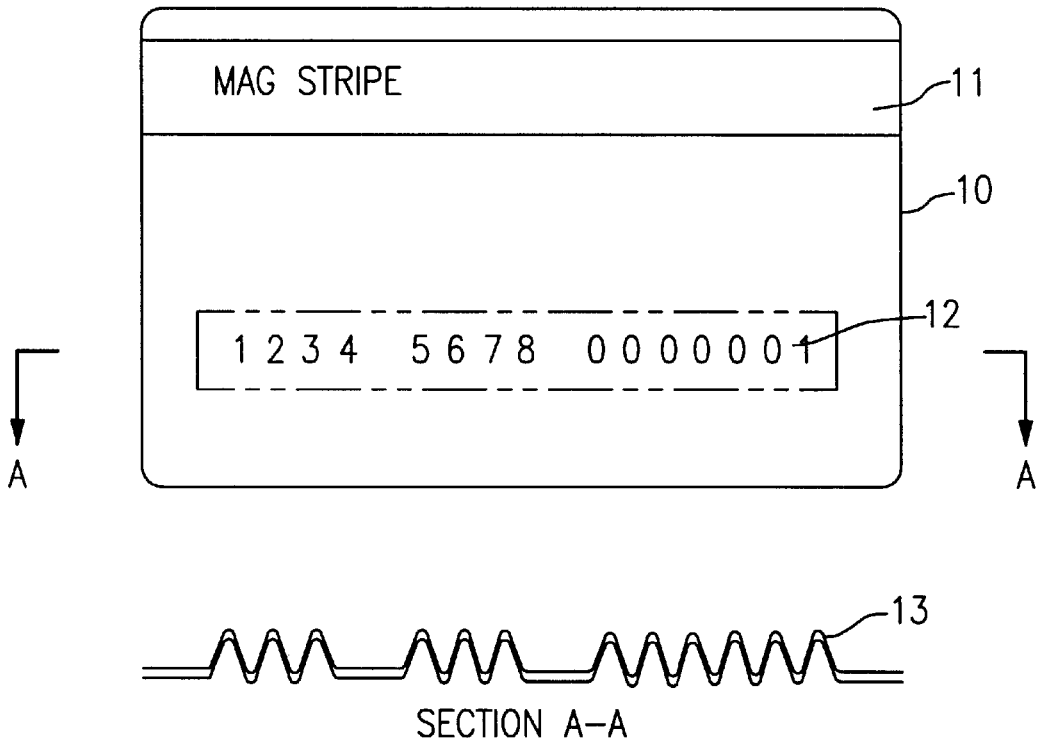
FIG. 7 is a view showing the card 10 processed by the card issuer 1 according to the embodiment.
Figure 8:
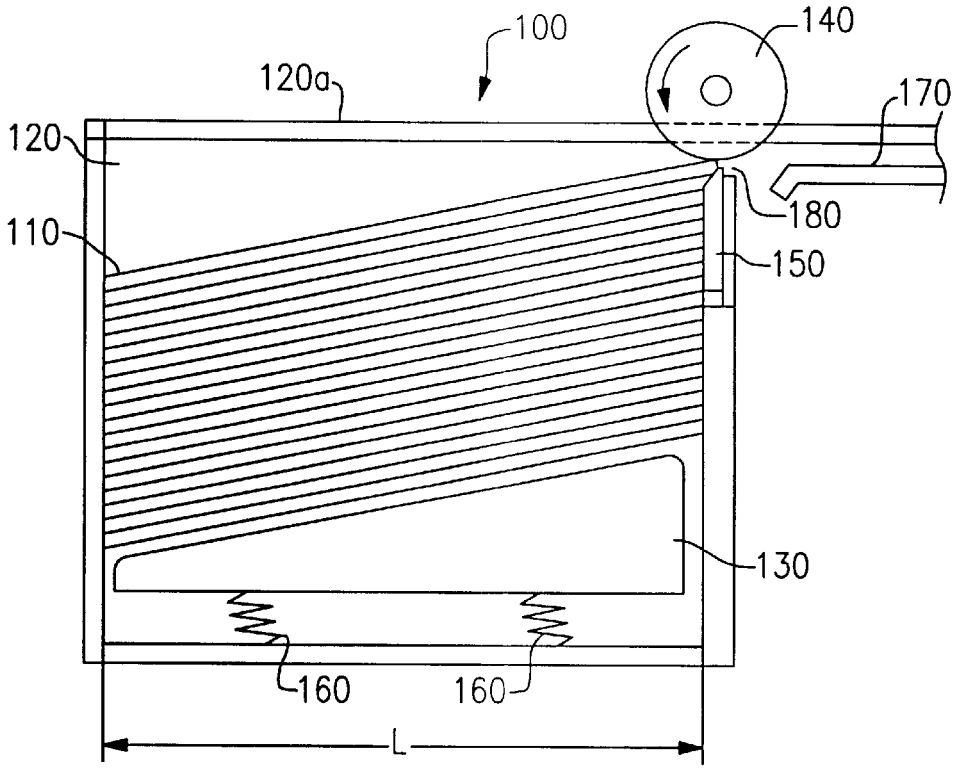
FIG. 8 is a view showing the card issuer 100 disclosed in the gazettes of Japanese Patent Laid-Open Nos. Sho 56-45196 and Hei 7-35210.
Figure 9:
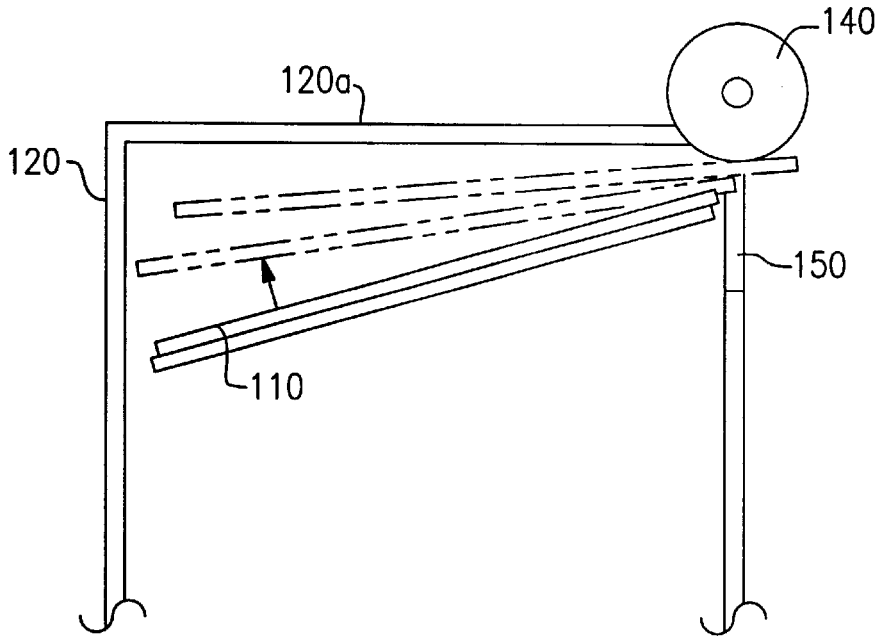
FIG. 9 is a view showing the card issuer 100 disclosed in the gazettes of Japanese Patent Laid-Open Nos. Sho 56-45196 and Hei 7-35210.
Figure 10:
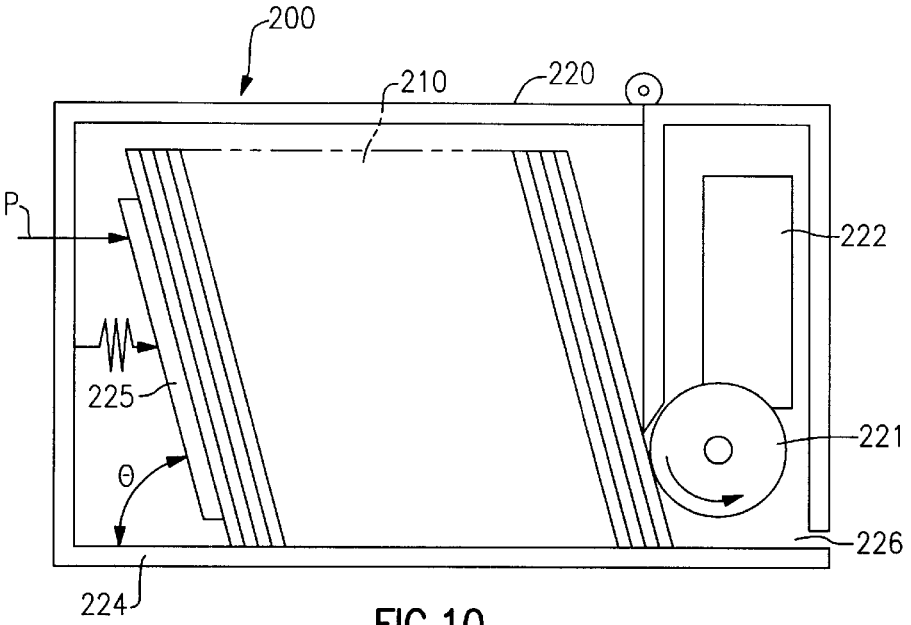
FIG. 10 is a view showing the card issuer 200 disclosed in the gazette of Japanese Patent Laid-Open No. Hei 7-53068.
Figure 11:
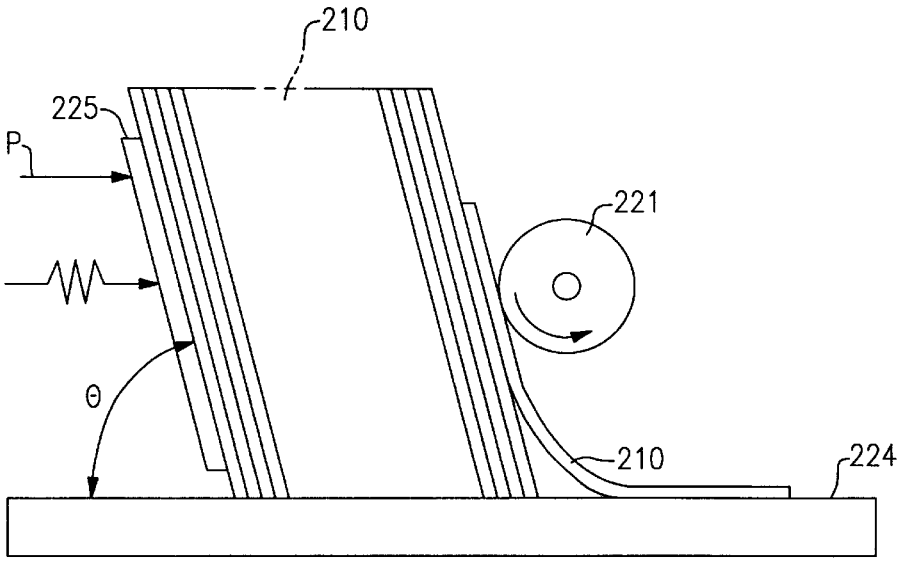
FIG. 11 is a view showing the card issuer 200 disclosed in the gazette of Japanese Patent Laid-Open No. Hei 7-53068.

The card issuer 1 is designed for issuing a card 10 optionally provided with a magnetic recording area 11 shown in FIG. 7 such as a cash card or a credit card.

As shown in FIG. 7, the card 10 has a card serial number 12 marked thereon. In the example of FIG. 7, "123456780000001" is the serial number 12. This marking constitutes embosses 13. FIG. 7 also shows a cross sectional view of the card 10 along with A—A. This cross sectional view along A—A shows an example wherein two cards 10 are stacked with each other. With reference to the cross sectional view along A—A, it can be seen that the embosses 13 of the two cards are overlapped with each other. Note that in this embodiment, description will be made for the card 10 provided with the magnetic recording area 11, which is taken as an example. However in this embodiment, the magnetic recording area 11 is not essential. In other words, although it is a precondition that description will be made for the card 10 having the embosses 13, constitutions thereof other than the above are optional.

As shown in FIG. 1, the card issuer 1 comprises a card supplier 2 and a card reader 3.

The card supplier 2 functions to select one card from a group of cards 10 stacked in a large number and to supply the card to the card reader 3 when the card 10 is issued. The card supplier 2 comprises two card stackers, that is, a first card stacker 4 and a second card stacker 5. The first and second card stackers 4 and 5 are constructed in box-shaped structures having openings on the tops, and can respectively stock a hundred stacked cards 10 in a vertical direction. A first weight 41 is provided on the first card stacker 4, and a second weight 51 is provided on the second card stacker 5. A sphere 41*b* rotatably supported is provided under the first weight 41, and a sphere 51*b* rotatably supported is provided under the second weight 51. Moreover, a first feeding belt 42 is provided under the first card stacker 4, and a second feeding belt 52 is provided under the second card stacker 5. The first and second feeding belts 42 and 52 are respectively rotated counterclockwise by pulleys P, which are driven to rotate by driving sources (not shown). Furthermore, the first and second feeding belts 42 and 52 can be respectively set close to and far from the first and second card stackers 4 and 5. In the case of selecting and feeding the card 10 from the second card stacker 5, the first feeding belt 42 falls down. In this embodiment, as means for selecting and feeding the card 10 from the first and second card stackers 4 and 5 one by one, the first and second feeding belts 42 and 52 are used. However, instead of these feeding belts, rollers can be used. Moreover, a mechanism used in this embodiment is not limited to the one in which the card 10 is selected by a frictional force of the belt or the roller, but a mechanism in which the card 10 is extruded by use of an extrusion member can also be adopted.

The card reader 3 comprises magnetic means for writing in and reading out necessary data for the optional magnetic recording area 11 of the card 10 selected and fed from the first card stacker 4 or the second card stacker 5. For the magnetic means, the conventionally known magnetic head may satisfactorily be used. Carrier rollers R for carrying the card 10 are provided in the card reader 3. The carrier rollers R are rotatably driven by driving sources (not shown). The card 10 fed from the first card stacker 4 or the second card stacker 5 stops once by a stop of the carrier rollers R at a predetermined position, where the data is written in or read out. After the data is written in or read out, the card 10 is carried toward a card issue port E by the carrier rollers R.

Figure 2:
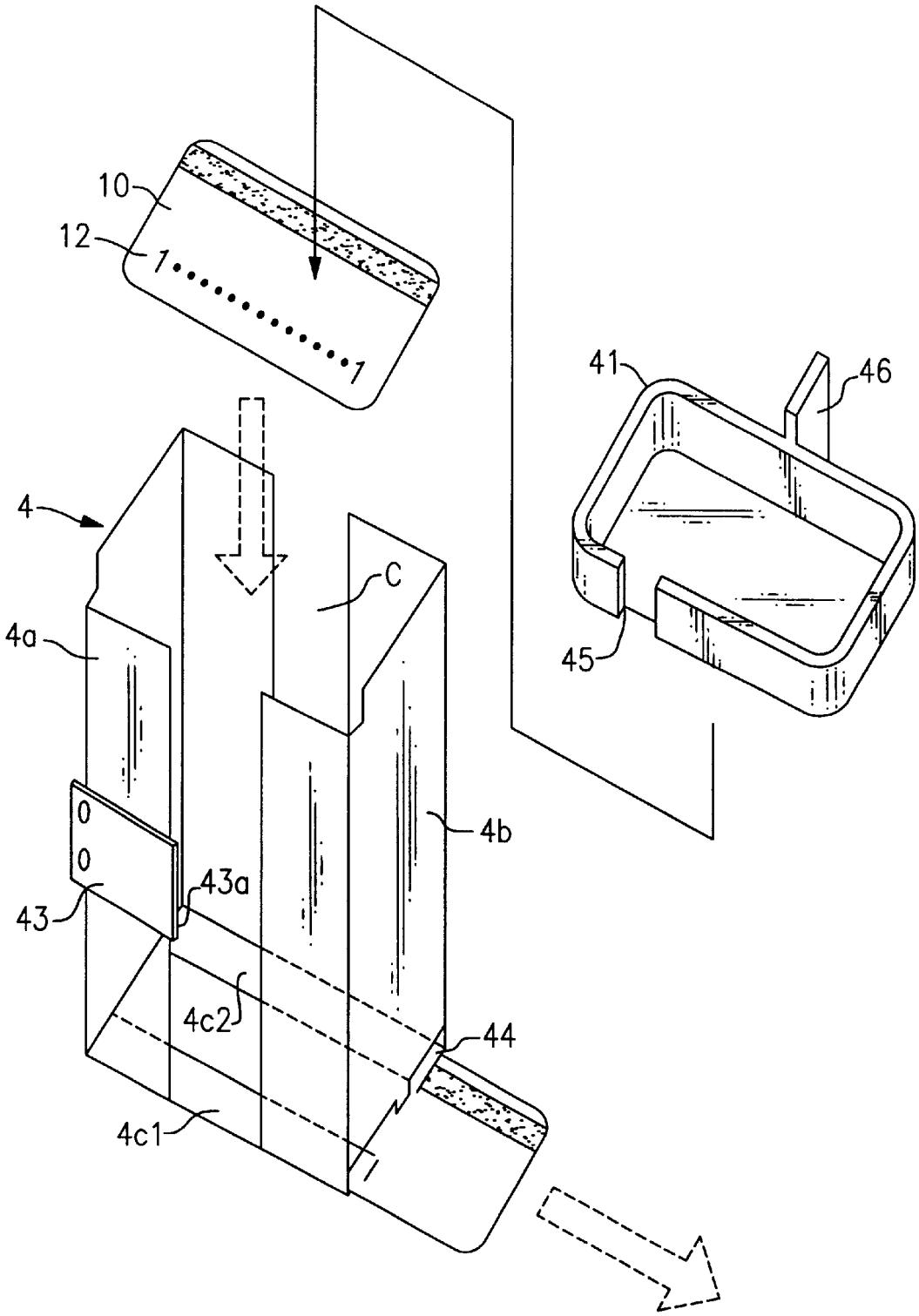
FIG. 2 is a perspective view showing the first card stacker 4 according to the embodiment.

FIG. 2 is a perspective view showing a construction of the first card stacker 4. Note that description for the second card stacker 5 is omitted since it has the same construction as the first card stacker 4.

As shown in FIG. 2, the first card stacker 4 is basically constituted of a pair of holding floors 4*c* and 4*c*2 disposed so as to be spaced by a predetermined interval with each other and U-character shaped side walls 4*a* and 4*b* erected vertically from the holding floors 4*c* and 4*c*2. A feeding port 44 for feeding the card 10 is formed at a lower edge of the side wall 4*b*. The first card stacker 4 stacks and holds the cards 10 having the optional embosses 13 formed thereon in a card stack area C formed by the holding floors 4*c* and 4*c*2 and the side walls 4*a* and 4*b*. When the first feeding belt 42 is driven while making the first feeding belt 42 contact the lower surface of the card 10 located at the lowermost portion among the cards 10 stacked in the first card stacker 4, the card 10 is fed through the feeding port 44 to the card reader 3. As apparent from the foregoing, a predetermined space between the holding floors 4*c* and 4*c*2 is provided such that the first feeding belt 42 can contact the card 10. Separating means are provided on the side wall 4*a*, by a triangular projection 43*a* projecting toward the card stack area C. The function of the separating means 43 will be described later in detail.

The first weight 41 has an outside dimension slightly smaller than that of the card stack area C of the first card stacker 4. The first weight 41 is mounted over the card 10 at the uppermost position of the stacker 4, after a predetermined number of the cards 10 (100 cards in this embodiment) is stacked in the card stack area C of the first card stacker 4. Accordingly, every time a card 10 is selected and fed, the first weight 41 falls down in the card stack area C of the first card stacker 4. In the first weight 41, a notch 45 is preferably formed for avoiding interference between the first weight 41 with the projection 43*a* of the separating means 43. Moreover, in the first weight 41, a handle 46 is preferably formed, and the first weight 41 is manipulated with this handle 46. Furthermore, although it is not shown in FIG. 2, a sphere 41*b* is preferably disposed under the first weight 41. The sphere 41*b* is rotatably fitted to the first weight 41.

Figure 3:
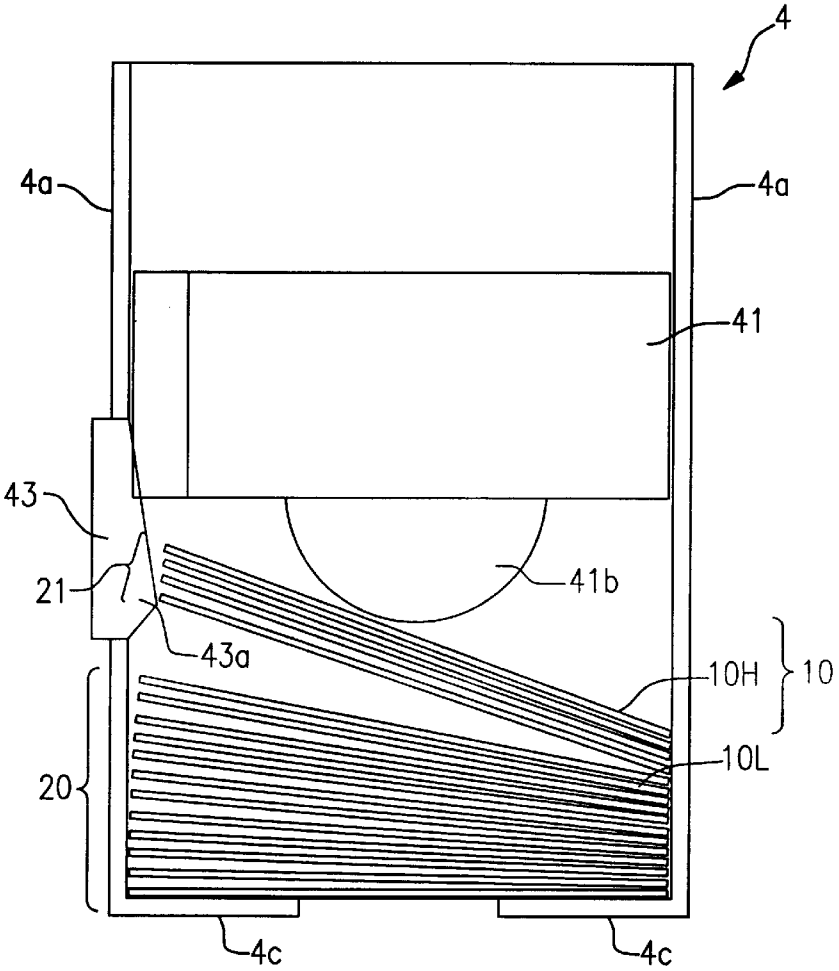
FIG. 3 is a cross sectional view showing an example where a predetermined number of the cards 10 are stacked in the first card stacker 4.

FIG. 3 is a cross sectional view showing a condition wherein a predetermined number of the cards 10 are stacked in the first card stacker 4. Although the optional magnetic recording area 11 and the optional embosses 13 of the card 10 are omitted in the drawing, the magnetic recording area 11 are positioned on the right portion of the card 10 and the embosses 13 of the card 10 are positioned on the left portion of the card 10 in the drawing.

In FIG. 3, the cards 10 are classified and stacked in a first stack section 20 and a second stack section 21 in the first card stacker 4. Herein, the cards 10 stacked in the first stack section 20 are referred to as cards 10L, and the cards 10 stacked in the second stack section 21 are referred to as cards 10H. The number of the cards 10L stacked in the first stack section 20 is set to about 20 to 30. This numerical value of 20 to 30 is the number enabling the card 10 to be constantly selected from the stacked cards as described above. This number is experimentally derived and would be different for a different card technology. Moreover, the number of the cards stacked in the second stack portion 21 is 70 to 80 since the number of the cards is obtained by subtracting the number of the cards 10L from a hundred, which is a number of cards stacked as a whole. Note that the number of the cards 10 shown in FIG. 3 does not depict the actual number of the cards 10H and 10L because of limitations from making the drawing.

The first and second stack sections 20 and 21 are separated from each other by the separating means 43. In other words, all the cards 10L stacked in the first stack section 20 exist below the separating means 43, and left edges of all the cards 10H stacked in the second stack section 21 exist above the projection 43*a* of the separating means 43.

As shown in FIG. 3, one edge of the card 10H in a width direction thereof, the card 10H being located at the lowermost portion of the cards 10H stacked in the second stack portion 21, is engaged with the triangular projection 43*a* of the separating means 43. And the other edge of the card 10H is positioned on the card 10L located on the uppermost portion among the cards 10L. Accordingly, on the right edge portions of the cards 10L, that is, on an area where the embosses 13 are not formed, the weight of the cards 10H is applied. However, the weight of the cards 10H is not applied on the left edge portions of the cards 10L. As described above, since the embosses 13 exist on the left portion of the card 10, the load of the cards 10H is not applied on an area where the embosses 13 of the cards 10L exist.

A degree of the overlap of the embosses 13 is affected by the number of the stacked cards 10L, that is, the weight of the cards 10L. If the number of the stacked cards is small, the overlap of the embosses 13 is light. Accordingly, the card 10L at the lowermost portion can be easily selected by the first feeding belt 42. According to the study of the present inventors, if the number of the stacked cards is less than about 20 to 30, the overlap of the embosses 13 of the cards 10 does not occur, or even if it occurs, the overlap is light. This number of 20 to 30 is a value confirmed experimentally by use of magnetic cards such as currently used cash cards or credit cards, which are regulated in JIS. Accordingly, it is needless to say that this number may vary depending on a dimension of handled cards 10 or a state of embosses 13 thereof The present invention is not limited to the above number 20 to 30.

As described above, the load of the cards 10H is not applied to the area where the embosses 13 of the cards 10L exist. Accordingly, although a hundred cards 10 are stacked in the first card stacker 4, the card 10L located at the lowermost portion of the first stack portion 20 can be easily selected. Moreover, the number of the cards 10H stacked in the second stack portion 21 is smaller compared with the number of the entire stacked cards. Accordingly, the overlap of the embosses 13 of the cards 10H stacked in the second stack portion 21 is reduced.

Herein, when the number of the entire stacked cards is defined as M (100) and the number of the cards 10L stacked in the first stack section 20 is defined as m, the number of the cards 10H stacked in the second stack section 21 is represented as (M−m).

The card 10L located at the lowermost portion of the cards 10L is selected one by one at each time when a card 10 is requested to be issued. After the above operation is performed once, the number of the cards 10L is to be changed into (m−1). However, the selected cards 10L are replaced with the cards 10H which are stacked in the second stack section 21. Accordingly, as long as the cards 10H exist in the second stack section 21, the number of the cards 10L in the first stack section 20 is the predetermined m (constant). This indicates that in the case where the residual number of the cards exceeds a predetermined value (m), the load applied to the area in which the embosses 13 of the card 10L located at the lowermost portion of the first stack section 20, is controlled within a predetermined range. This control is performed by the separating means 43. When the selecting of the cards 10L is repeated, the cards 10H in the second stack portion 21 are eventually used up. Then, the number of the cards 10L in the first stack portion 20 is sequentially reduced such as: (m−1), (m−2), (m−3).

Figure 4:
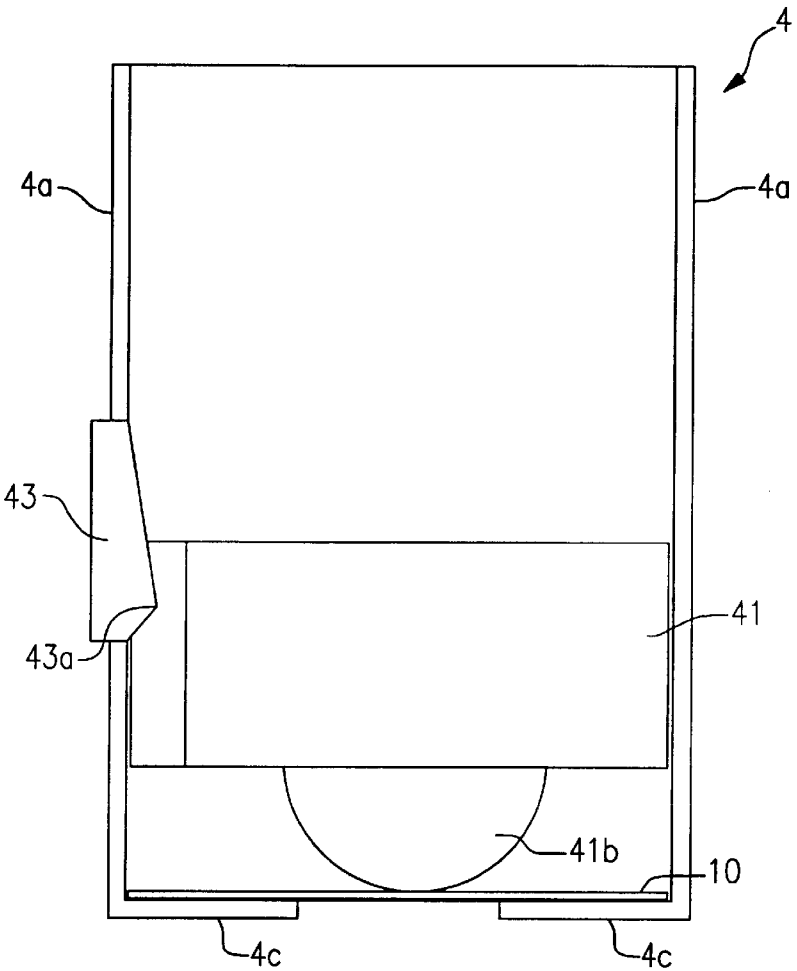
FIG. 4 is a view showing an example where the residual number of the cards 10 becomes one.

FIG. 4 shows a state where the residual number of the cards 10 is one after the cards 10 are sequentially selected. When the feeding belt 42 is driven in this state, the card 10 is selected to the front of the drawing. In this case, since the sphere 41*b* of the first weight 41 contacts the card 10 by a point there between, the sphere 41*b* and the card 10 are easily slidable relative to each other. This results in suppressing a frictional force between the card 10 and the sphere 41*b*. The frictional force between the card 10 and the sphere 41*b* can be further reduced by supporting this sphere 41*b* rotatably.

The first weight 41 imparts a predetermined frictional force between the card 10 to be selected and the feeding belt 42 when the residual number of the cards 10 becomes smaller as described above. However, if the first weight 41 is too heavy, the overlap of the embosses 13 of the cards 10 become significant. Accordingly, it is necessary to determine the weight of the first weight 41 also in consideration of the above-described overlap.

The separating means 43 of the first card stacker 4 according to this embodiment has also a function to automatically replace the selected cards 10L with the cards 10H of the equivalent number to the cards 10L. This function will be described with reference to FIGS. 5(*a*) and 5(*b*).

Figure 5:
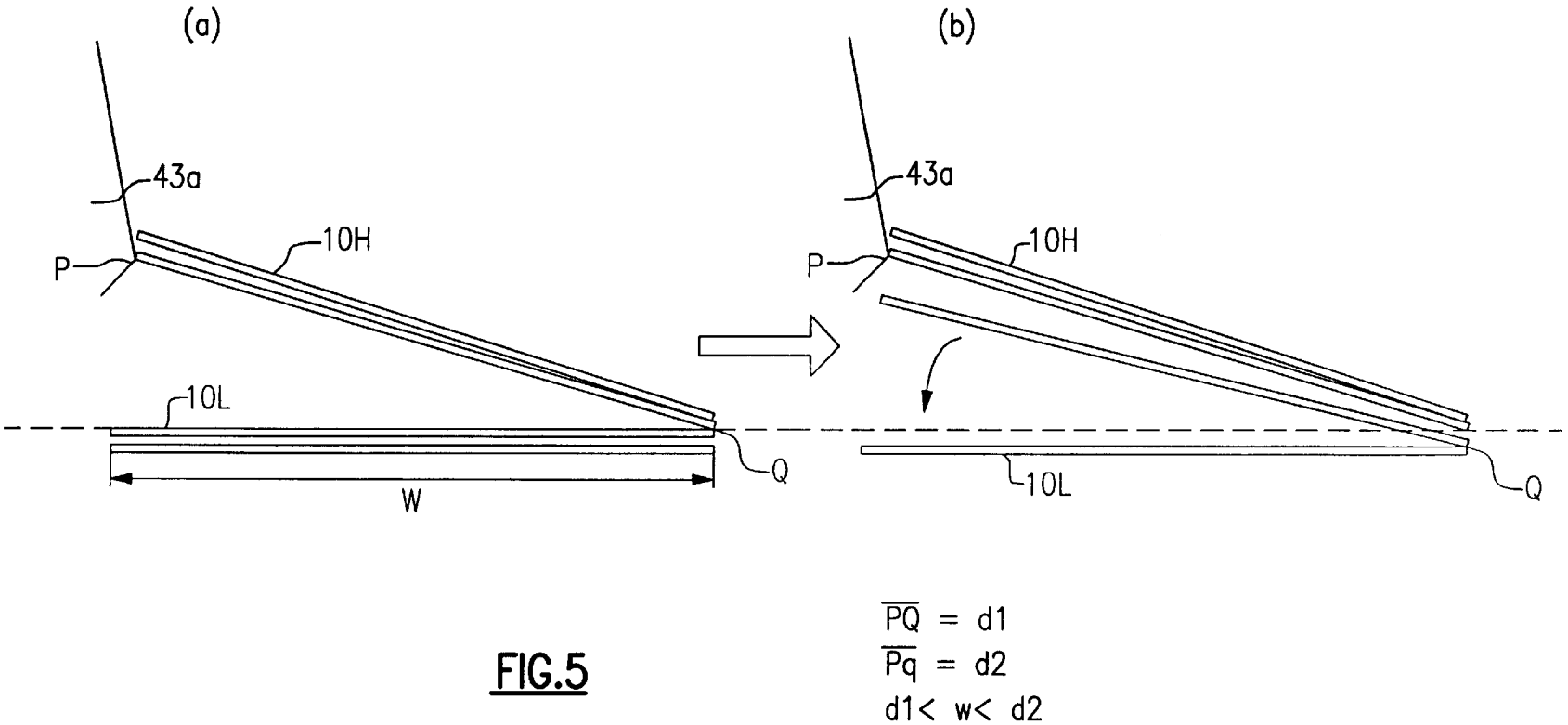
FIGS. 5(*a*) and 5(*b*) are explanatory views showing a process for automatically replacing the fed cards 10L with the cards 10H after the cards 10L are selected and fed.

FIGS. 5(*a*) and 5(*b*) are explanatory views showing a process for automatically replacing the fed cards 10L with the cards 10H after the cards 10L are selected and fed. FIG. 5(*a*) schematically shows a state before the card 10L is selected and fed, and FIG. 5(*b*) a state after the card 10L is selected and fed. The cards 10L are actually stacked slanting by an affect of the embosses 13 as shown in FIG. 3. However, the slant is not shown herein.

In FIG. 5(*a*), a distance between a tip P of the projection 43*a* of the separating means 43 and a right edge Q of the card 10L located at the uppermost portion is defined as d1. This d1 is set so as to have a value slightly smaller than a width w of the card 10L (card 10H). Specifically, a relation of d1<w is established. Accordingly, the left edge of the card 10H at the lowermost portion is engaged with the projection 43*a*.

When the card 10L at the lowermost portion among the cards 10L is fed, the uppermost position of the cards 10L falls down by a thickness of the card 10L. FIG. 5(*b*) shows this state. When a distance between the right edge q of the card 10L at the uppermost portion and a tip P of the projection 43*a* of the separating means 43 in the above-described fallen state is defined as d2, a relation of d1<d2 is established. Moreover, this d2 is set so as to have a value slightly larger than the width w of the card 10L (card 10H). Specifically, a relation of w<d2 is established. Accordingly, the engagement of the left edge of the card 10H at the lowermost portion with the projection 43*a* of the separating means 43 is released. For this reason, the concerned card 10H rotates with the point q as a center and drops by the gravity.

As described above, according to this embodiment, the fed cards 10L can be automatically replaced with the cards 10H by employing an extremely simple construction, that is, providing the separating means 43.

In the embodiment described above, the projection 43*a* of the separating means 43 is formed by a triangular shape. However, the present invention is not limited to this triangular-shaped projection 43*a*. As long as the projection 43*a* can function as described in this embodiment sufficiently, the projection 43*a* can take any shape known in the art. Although the projection 43*a* can take various shapes, if the projection 43*a* is formed in a triangular shape as in this embodiment, the left edge of the card 10H can smoothly fall down along a slant surface of the triangle. Such smooth falling can be achieved if the surface contacting the left edge of the card 10H is provided by a smooth slant surface, which is not limited to the triangular shape of the projection 43*a*.

In this embodiment, the cards 10 are stacked in the first card stacker 4 in such a manner that the portions of the cards 10 which have the embosses 13 formed thereon are disposed close to the separating means 43. This stacking of the cards 10 with such disposal is provided to avoid load application to the embosses 13 of the cards 10L stacked in the first stack portion 20 as described above. In the present invention, it is most desirable that the cards 10 are stacked in such a manner. However, the cards 10 may also be stacked in such a manner that the portions of the cards 10 which have the magnetic recording area 11 are disposed close to the separating means 43 according to the form of the embosses.

In this embodiment, the separating means 43 are preferably provided on a surface of the side wall 4*a* which corresponds to a width direction of the cards 10. However, the separating means 43 may also be provided in other ways including: on the surface of the side wall 4*a* which corresponds to a longitudinal direction (feeding direction) of the cards 10.

Figure 6:
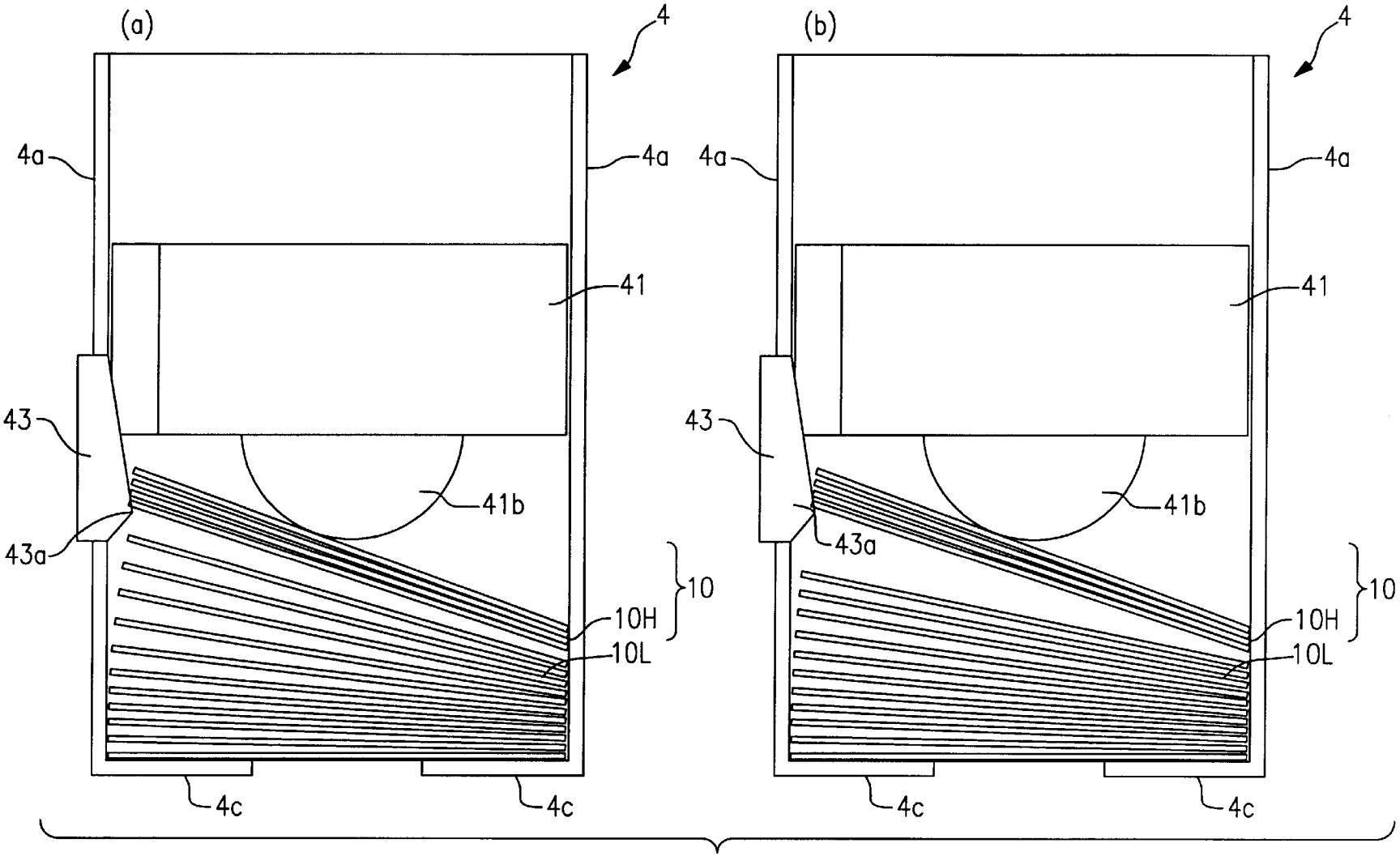
FIGS. 6(*a*) and 6(*b*) are explanatory views for explaining a difference of the heights of the stacked cards depending on the forming positions of the embosses 13 wherein, FIG. 6(*a*) shows a condition where the embosses 13 are formed on the centers of the cards 10 in the width direction, and FIG. 6(*b*) a condition where the embosses 13 are formed on the edge portions of the cards 10 in the width direction.

The first card stacker 4 can flexibly deal with various types of cards 10 by optimizing a disposal position of the separating means 43 in a vertical direction. In this embodiment, formation of the embosses 13 of the cards 10 on edge portions thereof in the width direction is exemplified. However, there are other types of cards 10 having embosses 13 formed around centers thereof in the width direction. When such cards 10 are stacked, even if the cards 10 having the similar number to that of the cards 10 having the embosses 13 formed on edge portions thereof in the width direction, a height of the stacked cards 10 having embosses 13 formed around the centers in the width direction gets higher. FIGS. 6(*a*) and 6(*b*) show comparison of the heights. In other words, FIG. 6(*a*) shows a state where the cards 10 having the embosses 13 formed around the centers thereof in the width direction is stacked in the first card stacker 4, and FIG. 6(*b*) shows a state where the cards 10 having the embosses 13 formed on the edge portion thereof in the width direction (left side in the drawing) are stacked in the first card stacker 4. Note that the depiction of the embosses 13 is omitted in FIGS. 6(*a*) and 6(*b*). In the case of the cards 10 having the embosses 13 around the centers thereof in the width direction, a slant angle of the cards 10 stacked on the cards 10 becomes larger. Therefore, even if the number of the stacked cards 10 is the same as that of the cards 10 having the embosses 13 formed on the edge portion thereof in the width direction, the height of the stacked cards 10 gets higher as shown in FIG. 6. The slant angle of the cards 10 becomes largest in the case where the embosses 13 are formed on the center portions of the cards 10 in the width direction. At the same time, the height of the stacked cards 10 becomes highest. Accordingly, if a disposal height of the separating means 43 is set assuming the case where the embosses 13 are formed on the center portions of the cards 10 in the width direction, the separating means 43 can cope with the case where the cards 10 having the embosses 13 formed on other positions than the center portions (i.e. Optimized for all embossing positions).

Moreover, the case, where the number of the separating means 43 provided is one, is exemplified in this embodiment, but a plurality of the separating means 43 may be provided. If the number of the entire stacked cards 10 is increased, the number of the cards 10H stacked in the second stack portion 21 is increased, thus causing the problem of the overlap of the embosses 13. Accordingly, it is advantageous that the entire stacked cards 10 are classified into two or more groups by providing another separating means 43 in the second stack section 21.

As described above, according to the present invention, the card issuer, which is capable of accurately selecting one card from a state where the plurality of cards having the embosses formed thereon are stacked, can be provided. Particularly, the card stacker of the present invention is desirable also with regard to a cost, since one card can be selected from the state where the plurality of cards having the embosses formed thereon are stacked only by adding an extremely simple construction, that is, providing the projection.

While the preferred embodiment of the invention has been illustrated and described herein, it is to be understood that the invention is not limited to the precise construction herein disclosed, and the right is reserved to all changes and modifications coming within the scope of the invention as defined in the appended claims.

What is claimed is:

1. A card stacker method for issuing one of a plurality of cards, the card stacker method comprising the steps of:

supporting a first card edge of a first card on a card separator in a top card stacker section of a card stacker while a second card edge, opposite to the first card edge, is supported at a predetermined position in the card stacker;

providing a force to the cards in the top card stacker section, the force being provided by way of a rolling means;

issuing a second card from a bottom card stacker section of the card stacker in a direction such that the second card passes under the first card edge of the first card; and releasing the first card edge of the first card in the top card stacker section from the card separator when the second card edge of the first card is supported below the predetermined position in the card stacker.

2. The card stacker method according to claim 1 wherein the bottom card stacker section can hold up to a predetermined number of cards below the predetermined position in the card stacker.

3. The card stacker method according to claim 1 wherein the predetermined number is in the range of 20 to 30.

4. The card stacker method according to claim 1 wherein the card separator comprises a wedge shape.

5. The card stacker method according to claim 1 wherein the issuing step comprises frictionably moving a card from the bottom card stacker section.

6. The card stacker method according to claim 1 wherein the first edge of the first card is supported on the card separator such that the first edge is higher than the second edge of the first card.

7. A card stacker method for issuing one of a plurality of cards, the card stacker method comprising the steps of:

supporting a first card edge of a card on a card separator in a top card stacker section when a second card edge of the card is supported at a predetermined position in the card stacker; providing a force to the cards in the top card stacker section wherein the force is applied by way of a rolling means; and, releasing a first card edge of the card from the card separator in the top card stacker section when the second card edge of the card is supported below the predetermined position in the card stacker.

* * * * *